US006895840B2

(12) United States Patent
Schulz et al.

(10) Patent No.: US 6,895,840 B2
(45) Date of Patent: May 24, 2005

(54) WATER PUMP PLIERS WITH SINGLE-HAND CONTROL

(76) Inventors: Gunther Schulz, Ringelstrasse 22, 42897 Remscheid (DE); Bodo Nilles, Friedrich-Engels-Allee 254, 42285 Wuppertal (DE)

( * ) Notice: Subject to any disclaimer, the term of this patent is extended or adjusted under 35 U.S.C. 154(b) by 31 days.

(21) Appl. No.: 10/279,339

(22) Filed: Oct. 24, 2002

(65) Prior Publication Data

US 2003/0075026 A1 Apr. 24, 2003

Related U.S. Application Data

(63) Continuation of application No. 09/564,115, filed on May 3, 2000, now Pat. No. 6,497,165.

(30) Foreign Application Priority Data

May 3, 1999 (DE) ..... 299 07 864

(51) Int. Cl.[7] ..... B25B 7/04
(52) U.S. Cl. ..... 81/413; 81/357; 81/417
(58) Field of Search ..... 81/356–357, 407, 81/409.5, 413, 417

(56) References Cited

U.S. PATENT DOCUMENTS

| | | | |
|---|---|---|---|
| 3,005,368 | A | 10/1961 | Johnson |
| 3,521,510 | A | 7/1970 | Angquist |
| 3,675,359 | A | 7/1972 | Ohno |
| 4,074,597 | A | 2/1978 | Jansson |
| 4,635,510 | A | 1/1987 | Box |
| 4,651,598 | A | 3/1987 | Warheit |
| 4,893,530 | A | 1/1990 | Warheit |
| 5,660,089 | A | 8/1997 | Chow |
| 5,850,768 | A | 12/1998 | Chow |
| 5,887,495 | A | 3/1999 | Kao |
| 6,000,303 | A | 12/1999 | Chang |
| 6,202,518 | B1 | 3/2001 | Moffitt, Jr. et al. |
| 6,502,482 | B1 | 1/2003 | Putsch et al. |

FOREIGN PATENT DOCUMENTS

| | | |
|---|---|---|
| DE | 20 31 661 | 1/1971 |
| DE | 298 06 998 | 8/1998 |
| GB | 1 265 295 | 1/1972 |
| WO | WO 00/13856 | 3/2000 |

*Primary Examiner*—James G. Smith
(74) *Attorney, Agent, or Firm*—Brinks Hofer Gilson & Lione

(57) ABSTRACT

Water pump pliers consisting of two pincer parts crossing themselves in a connecting region, each consisting of a handle portion and a jaw wherein said pincer parts are movably connected in said connecting region in such a way that said first pincer can be displaced relative to the second pincer to adjust a jaw opening-width on the one hand, and that the pincer parts with jaws can reciprocally pivot on the other hand. A blocking means is provided in such a manner that further shifting of the first pincer part is blocked when the jaws stop against a workpiece to be gripped. A spring element is installed between the pincer parts in such a way that a releasing force from the spring, operating in the opening direction of the jaws, acts upon the pincer parts. The spring element is designed and connected with the handle portions of the two pincer parts in such a way that the spring element, in addition to generating the releasing force, also acts upon the first pincer part with a torque directed around a spring fastening point in such a way that the jaws automatically move into a fully opened opening width following a manual release.

25 Claims, 7 Drawing Sheets

WATER PUMP PLIERS WITH SINGLE-HAND CONTROL

Figure 1:
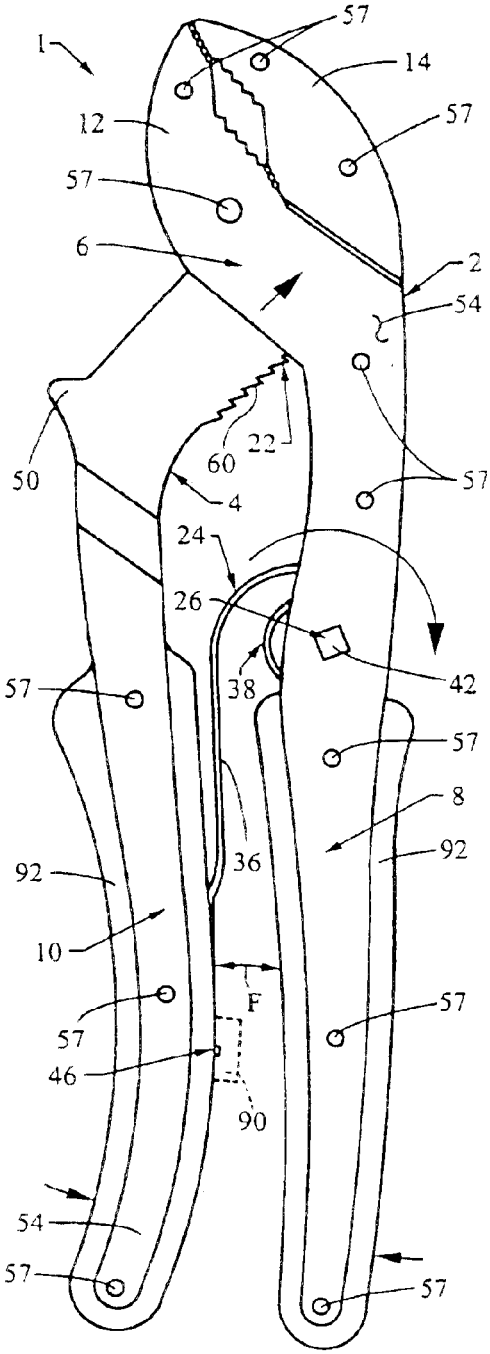

This patent application is a continuation of U.S. patent application Ser. No. 09/564,115, which was filed on May 3, 2000 now U.S. Pat. No. 6,497,165.

The present invention relates to a pair of water pump pliers, consisting of two pincer parts crossing themselves in a connecting region, each consisting of a handle portion and a jaw, wherein the pincer parts are movably connected in the connecting region in such a way, that the first pincer can be displaced relative to the second pincer to adjust a jaw opening-width that is needed for gripping or is optimal at the present time on the one hand, and that the pincer parts for grabbing with the jaws can reciprocally pivot on the other hand, wherein blocking means are provided in such a manner that further shifting of the first pincer part is blocked when the jaws stop against a workpiece to be gripped, and wherein a spring element is installed between the handles of the pincer parts in such a way, that a releasing force from the spring, operating in the jaws' opening direction, acts upon the pincer parts.

A pair of water pump pliers of this type is known from DE-AS 2031661. These pliers are supposed to be easy to operate with only one hand, but this is only partially achieved, however. Starting with a completely open opening width between the jaws, they can indeed be automatically brought into the most favorable clamp setting in contact with the object or workpiece to be clamped by single-handed manipulation, i.e. by simply pressing the handles together with one hand. In this clamp setting, a detent pawl, which can shift and pivot within an elongated hole and which is provided as blocking means, is also blocked automatically. If the manual pressure is released, however, this simply causes the jaws to release the object and the blocking means to loosen. But then the pincer parts remain in this position, so that they have to be moved manually into the largest jaw opening-width by shifting them relative to each other, and this can only be done with two hands. Structurally, this is due to the fact that the spring element installed between the handles is designed as a hairpin-like spring washer or wound pivot spring, whose one end is rigidly and immovably attached to one handle. But the spring's other end abuts loosely on the other handle in such a way that this pincer part can be displaced relative to the adjacent end of the spring, whereby the pincer part can pivot around its point of contact with the spring like a seesaw. In this manner, the spring can indeed press the handles apart to release both the clamped object and the blocking means, but it won't cause the jaws to move into their fully open position.

A "true" pair of single-handed water pump pliers is indeed known from U.S. Pat. No. 4,651,598 and/or the parallel EP 0218760B1, since this pair of pliers does automatically return into a fully opened position after clamping. However, this is achieved by means that are extraordinarily expensive structurally. Instead of a simple spring element (as in the above publication that establishes a species), a special rigid control arm is installed between the handles in this known pair of single-handed pliers. This arm is linked to one handle so that it can pivot and attached to the other handle so that it can be displaced. A special spring device with several individual spring elements is also provided for automatic sequence of motion. This design consequently results in a very large cost for components and assembly, which consequently causes quite high manufacturing expenses, especially for accommodating the spring elements partially within the handles.

It is the objective of the present invention to proceed from the state of the art described in the introduction and create water pump pliers of this type with "true" single-hand operation, which are distinguished by a particularly simple design and small manufacturing costs, few parts and simple assembly in particular.

This is achieved in accordance with the invention by designing the spring element and connecting it with the handle portions of the two pincer parts in such a way that the spring element, in addition to generating the releasing force, also acts upon the first pincer part with a torque directed around a spring fastening point in such a way that, by a corresponding shift of the first pincer part relative to the second pincer part, the jaws automatically move into a fully opened opening width following a manual release (letting-go of the handles to terminate the gripping). In accordance with the invention, the two handles are consequently connected exclusively by one simple one-piece spring element, which advantageously performs multiple functions, however, due to its development in accordance with the invention and its special means of attachment to the handles. The spring element thus generates the releasing force, which presses the handles apart to open jaws after the handles have been manually loosened or released, yet the spring element in accordance with the invention also applies a torque upon the first pincer part in such a manner that the part is shifted within the connecting region until the jaws have been opened completely as wide as possible.

A particularly simple and inexpensive design consists of, that the spring element is designed as a one-piece curved flat spiral spring whose first end is rigidly attached to the handle of the second pincer part and whose second end, located at the end of a curved spring segment that is spiraled to generate a torque, is rigidly attached to the handle of the first pincer part, i.e. torque-positive on one side and immobile on the other side, even viewed from the handle's longitudinal direction. Moreover, the spiral-shaped spring segment works like a clock spring, generating the torque that is provided to attain the completely opened position, whereas the remaining section of the spring, extended between the handles, mainly generates the releasing force. It is preferable for the spring element in accordance with the invention to be elastically deformable in such a way, that it causes all essential relative motions of the pincer parts or that they are at least possible.

Figure 2:
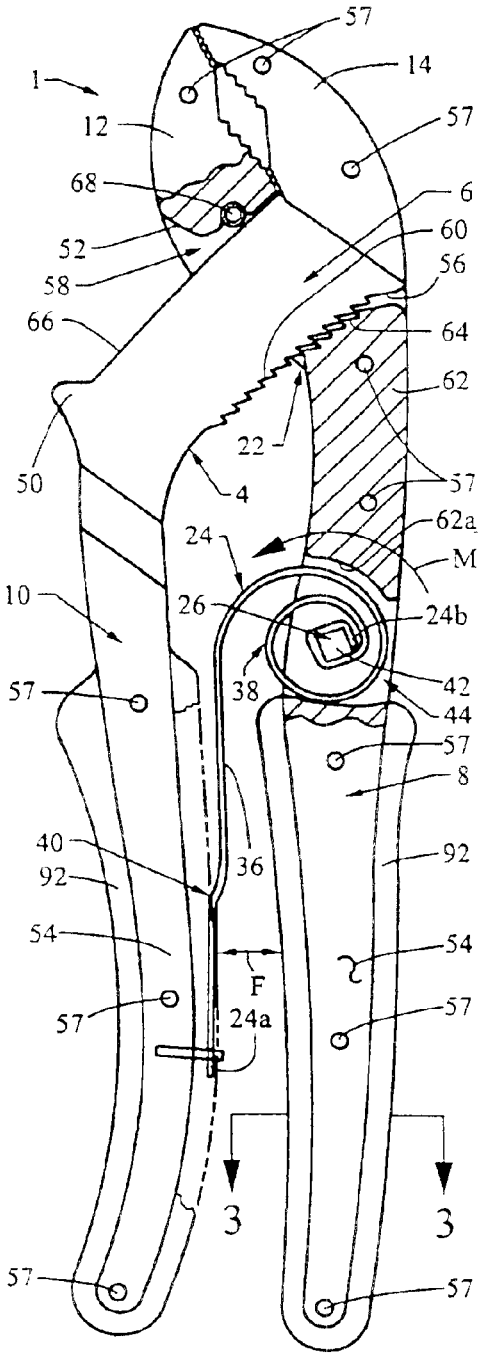
Figure 6:
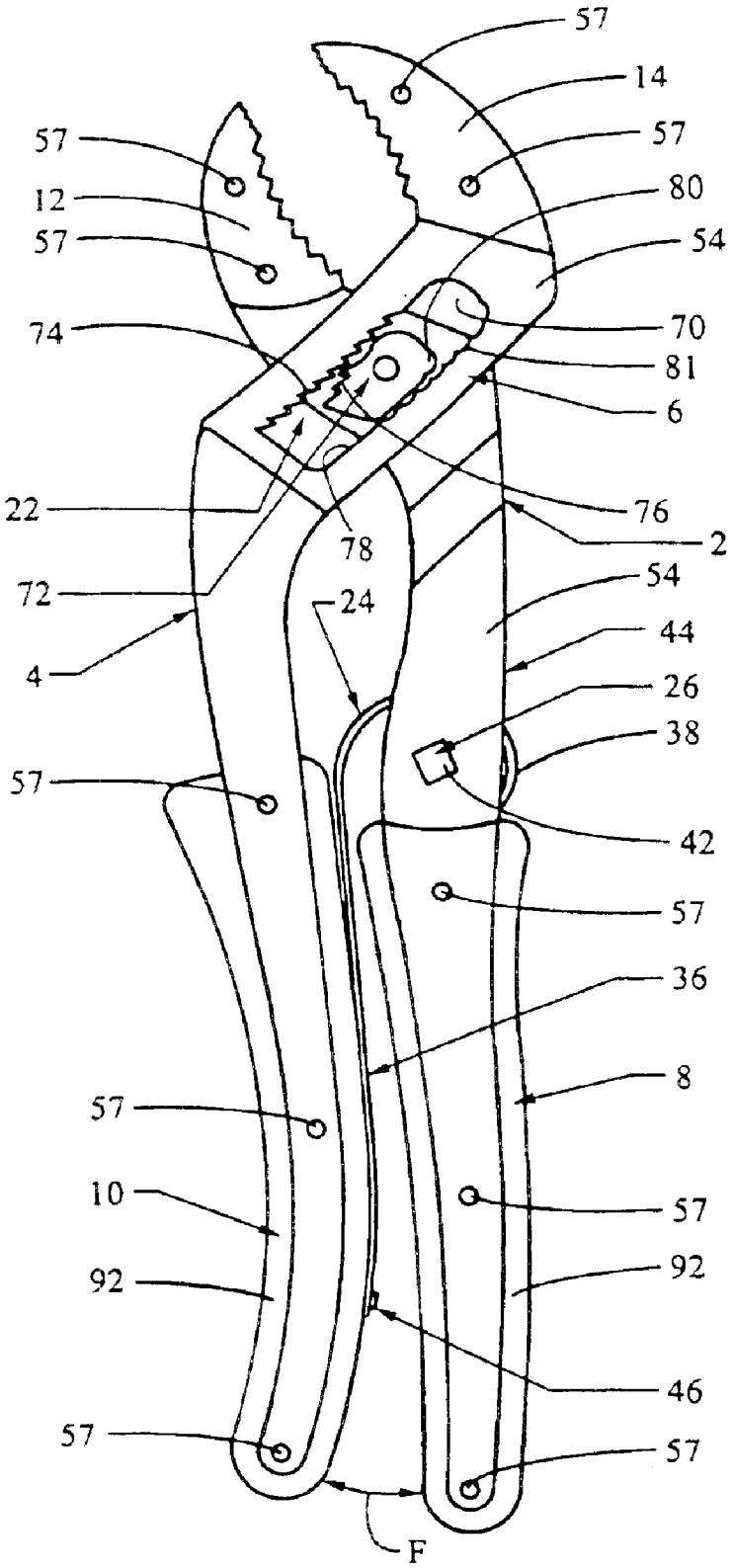
Figure 3:
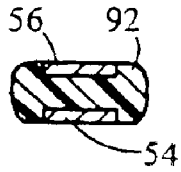
Figure 4A:
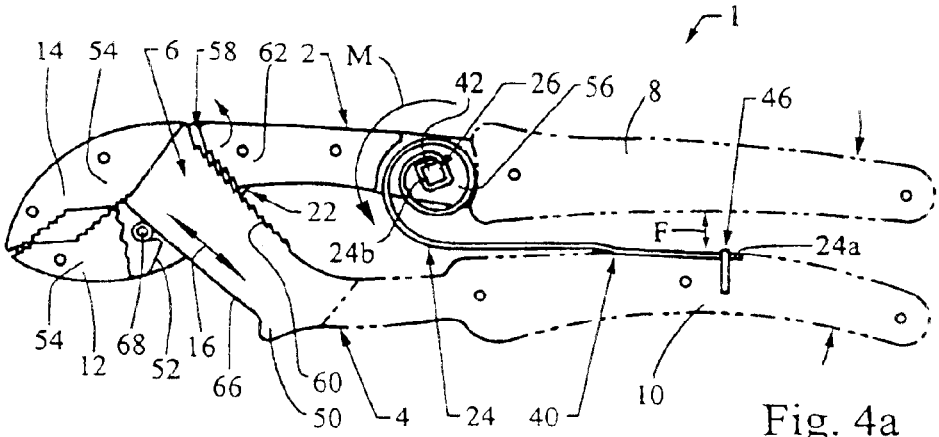
Figure 4B:
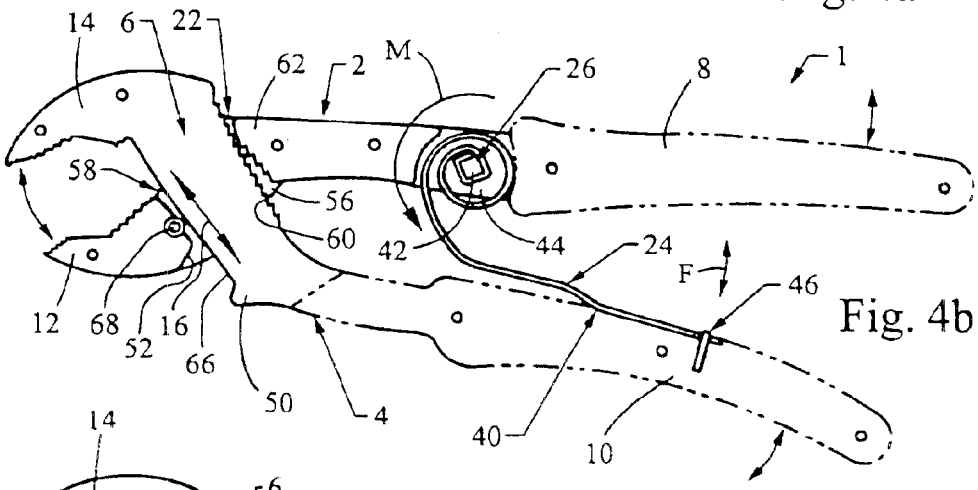
Figure 4C:
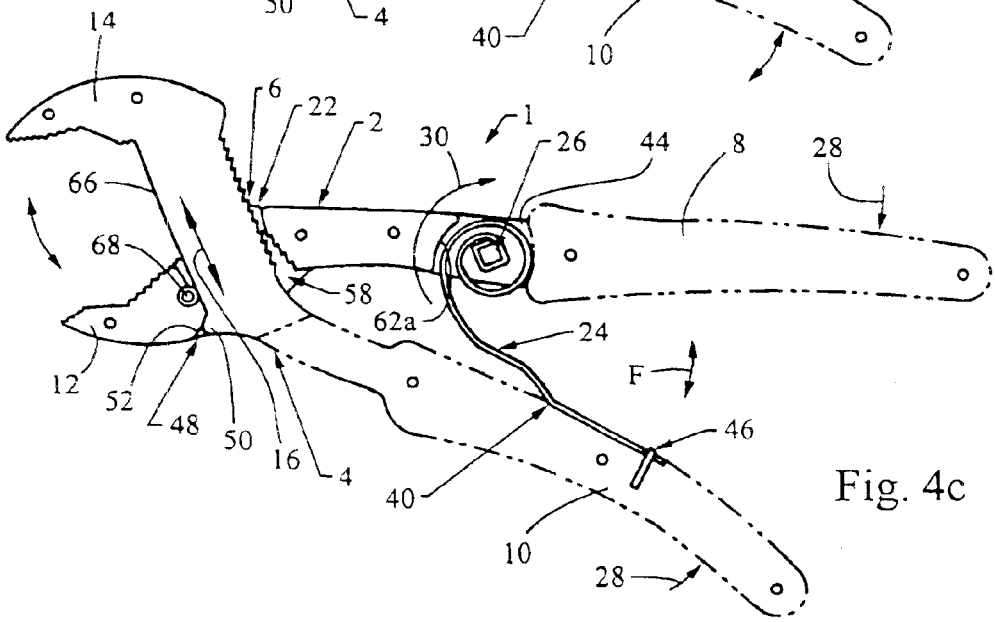
Figure 5A:
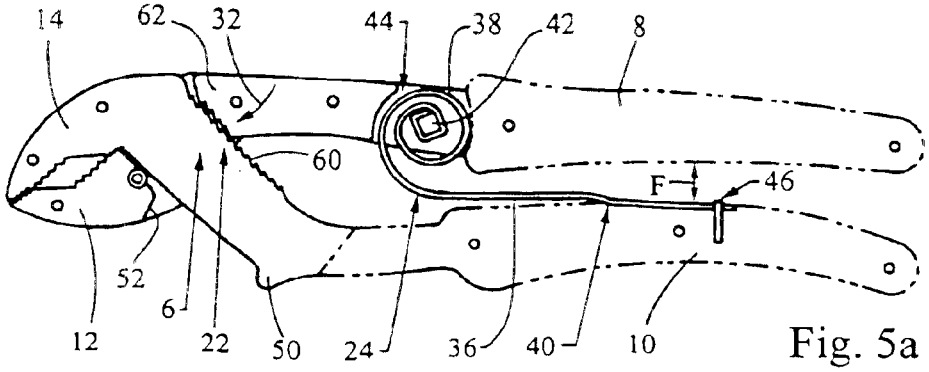
Figure 5B:
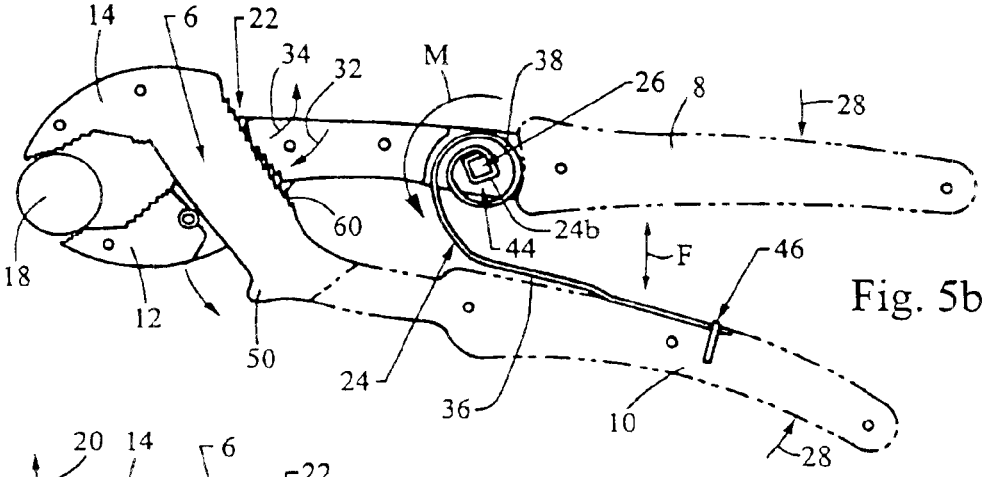
Figure 5C:
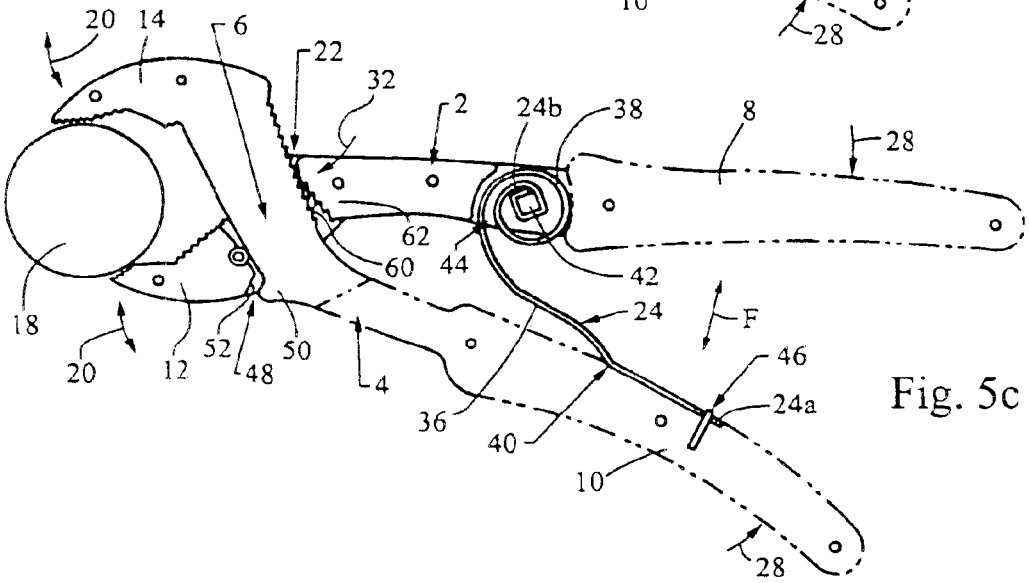
Figure 10A:
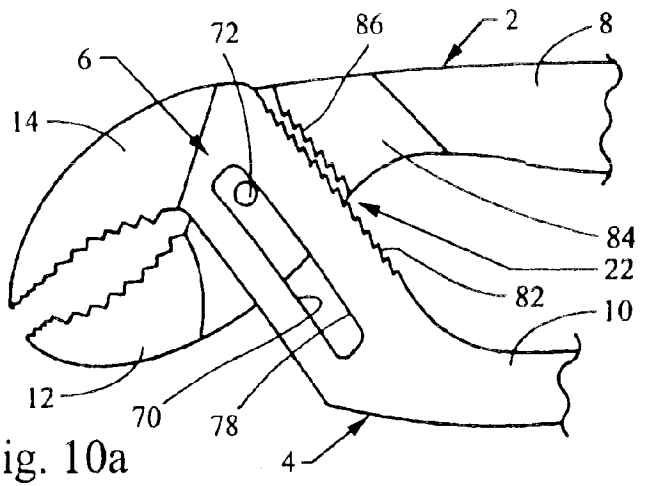
Figure 10B:
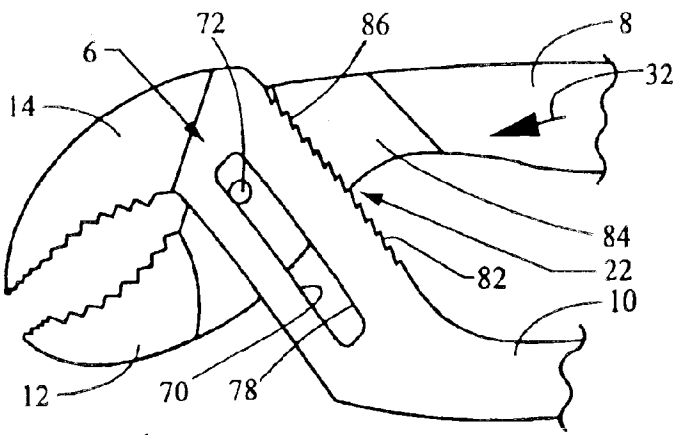
Figure 11:
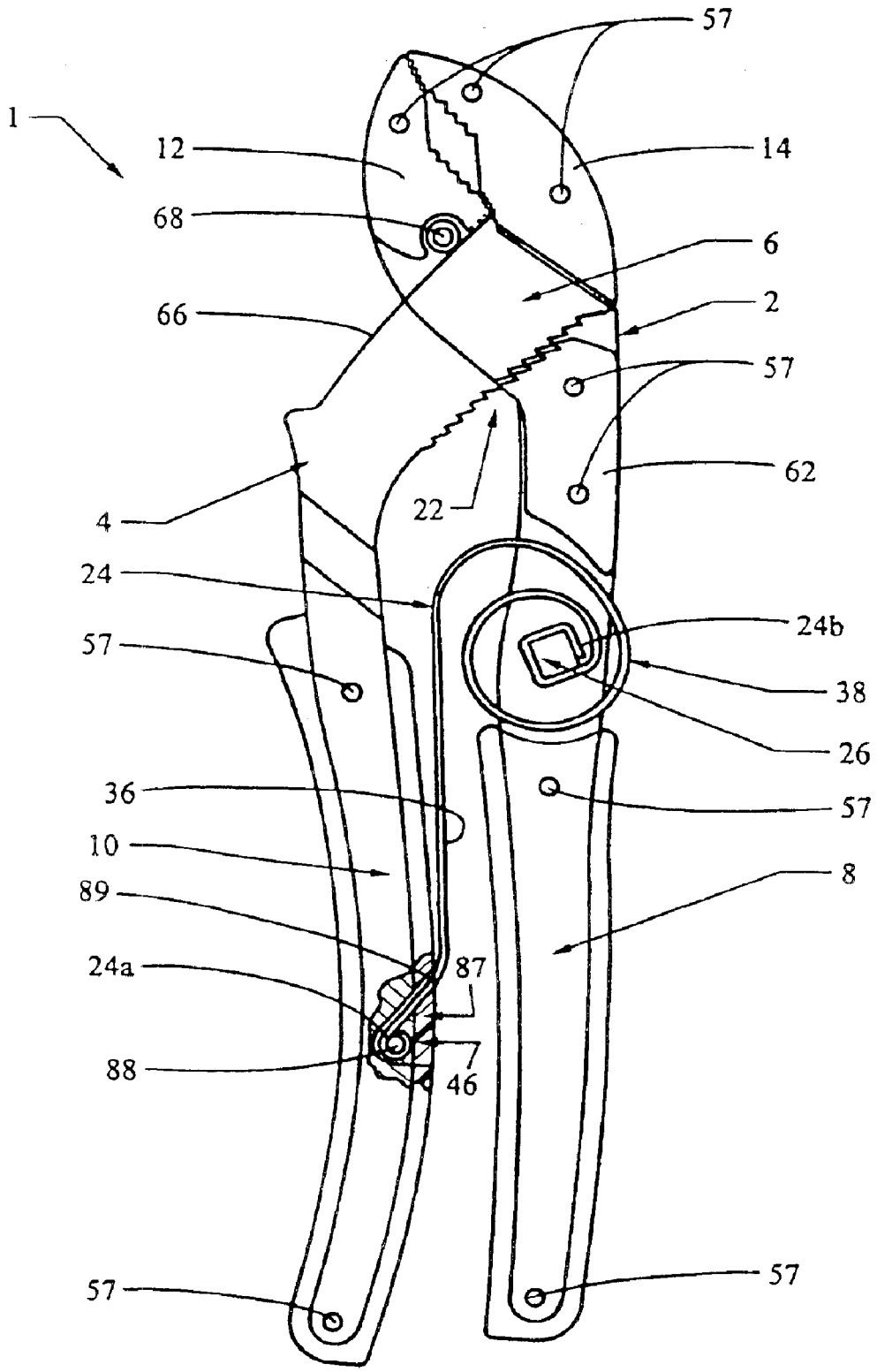

Additional preferable characteristics of the invention are contained in the dependent claims and in the following description:

The invention is supposed to be described in more detail based on several examples illustrated in the drawing. It shows:

FIG. 1 a view of a first preferable embodiment of the water pump pliers in accordance with the invention in a gripping position that is completely pressed together and as small as possible, FIG. 2 the view of FIG. 1 with components partially broken away so that essential elements can be seen better, FIG. 3 a cross section of a handle in the III—III plane of FIG. 2, FIGS. 4*a–c* smaller illustrations analogous to FIG. 2 in which the jaw opening-width is in different positions of adjustment, FIGS. 5*a–c* illustrations similar to FIGS. 4*a–c* in different grip positions, FIG. 6 an illustration analogous to FIG. 1 of another embodiment of the water pump pliers with a variation in the region of the blocking means, FIGS. 7*a*–10*b* Partial illustrations of the water pump pliers with additional variations in the region of the blocking means, and FIG. 11 an illustration analogous to FIG. 2 in a variation.

The same or functionally corresponding parts are always assigned the same reference labels in the various figures of the drawing and therefore, as a rule, each part only needs to be described once.

As can first be determined from FIGS. 1 and 2, a water pump pliers 1 in accordance with the invention consists of a first pincer part 2 and a second pincer part 4. These two pincer parts 2, 4 cross in a connecting region 6. Each part 2, 4 consists of a handle 8 or 10, respectively, that proceeds outwards from the connecting region 6 toward one side, and of a jaw 12 or 14, respectively, that points from the connecting region 6 toward the other side. The pincer parts 2, 4 are connected within the connecting region 6 so that they can move in such a way, that on the one hand the first pincer part 2 can be displaced relative to the second pincer part 4 to adjust the opening width of the jaws. This shifting movement is illustrated in FIGS. 4*a*–4*c* by a double arrow 16. From this, it can also be determined, that this shifting can vary the inside opening width between the jaws 12 and 14. On the other hand, the pincer parts 2, 4 can pivot reciprocally to grip with the jaws 12, 14. This gripping is illustrated in FIGS. 5*a*–5*c*, where double arrows 20 in FIG. 5*c* illustrate the holding of a workpiece 18 for clamping and the pivoting of the jaws 12 and 14 that is required to release it. Blocking means 22 for the gripping are provided in such a manner that further shifting of the first pincer part 2 relative to the second pincer part 4 is blocked when the jaws 12, 14 stop against the workpiece 18 to be gripped. Moreover, a spring element 24, is attached between the pincer parts 2, 4 in such a manner, that the spring's releasing force F, which operates in the opening direction of the jaws 12, 14 to loosen the clamping, acts upon the pincer parts 2, 4. This releasing force F also releases the blocking means 22 after gripping is over. In the figures, the releasing force F is drawn between the handles 8 and 10 in its direction of operation to press the handles 8 and 10 apart.

In accordance with the invention, the spring element 24 is now designed in such a manner, and is connected with the handles 8, 10 of the two pincer parts 2, 4 in such a manner, that the spring element not only generates the releasing force F, but also, in accordance with the invention, acts upon the first pincer part 2 with a torque M directed around a spring fastening point 26 in such a way that, by a corresponding shift of the pincer parts in the direction of the double arrow 16, the jaws 12, 14 automatically move into a fully opened opening width following a manual release i.e. letting-go of the handles 8, 10 to terminate the gripping. This normal position caused by the spring is illustrated in FIG. 4*c*. Starting from this completely open normal position, which is automatically attained in every case by the organization and arrangement of the spring element 24 in accordance with the invention, a standard manual pressing action on the handles 8 and 10 in the direction of the arrow 28, sketched in FIG. 4*c*, will cause the first pincer part 2 to be turned or pivoted like a seesaw around a center of motion formed by the fastening point 26 of the spring element 24. This motion of revolution, illustrated by arrow 30, is directed opposite the torque M in accordance with the invention. Since the blocking means 22 aren't blocked in this state, the motion causes a shift in connecting region 6 in the direction of the double arrow 16, whereby the opening width of jaws 12, 14 is reduced. The opening width continues to become smaller until the jaws 12, 14 stop against a workpiece. From this time onward, further pivoting of the pincer parts 2, 4 only still occurs around the specific point of abutment of the jaws 12, 14 on the workpiece 18. This results in engagement or blocking of the blocking means 22; see arrow 32 specifically illustrated in FIGS. 5*a*–5*c*, 7*a*, 8*b*, 9*b*, and 10*b*. The blocking means 22 then form a end stop in such a manner that the workpiece 18 can be tightly clamped between the jaws 12, 14 by stronger pressure on the handles 8, 10 in the direction of the arrow 28.

Upon subsequent release, i.e. letting go of the handles 8, 10, the releasing force F causes reverse pivoting in the direction of arrow 34 (FIG. 5*b*) to release the blocking means 22, so that, because of the effect of the spring element 24 in accordance with the invention, the torque causes the first pincer part 2 to rotate around the spring fastening point 26 again in reverse. This action causes a corresponding return shift in the connecting region 6 until the jaws 12, 14 have again reached their completely open position.

In a preferred embodiment, the spring element 24 is designed as a one-piece curved flat spiral spring made of spring steel and its first end 24*a* is rigidly attached to the handle 10 of the second pincer part 4. A basically straight spring segment 36, which freely stretches between the handles 8, 10 approximately in the direction of the connecting region 6 of the pincer parts 2, 4, is adjacent to this first end 24*a* of the spring. This spring segment 36 merges as one piece into a spirally curved spring segment 38 for generating the torque M, and its end, which forms the second end 24*b* of spring element 24, is rigidly attached to the handle 8 of the first pincer part 2, and indeed within the fastening point 26. A kink 40 is preferably formed approximately in the middle of the basically straight spring segment 36 in such a way that, in a certain travel, the spring segment 36 fits on the handle 10 up to the kink 40, and primarily so when the handles 8, 10 are pressed together. The section of the spring element 24 between the fastening point 24*a* and the kink 40 will only rise from the handle 10 somewhat shortly in front of the open position. This embodiment serves to increase the spring resistance as well as to control the kinematics. Proceeding from the second end 24*b* of the spring, which is rigidly attached torque-positive to the handle 8 of the first pincer part 2, the spiral spring segment 38 continues with increasing radius of curvature, in particular making approximately one or two spiral windings around the spring fastening point 26, and then merges steadily into the approximately straight spring segment 36 in one piece.

In the illustrated, preferred examples, the spring fastening point 26 is formed by a stud 42, which is fastened in a clearance 44 of the handle 8 provided to accommodate the spiral spring segment 38. This stud 42 features a cross section that departs from circularity, polygonal in particular (square as illustrated), wherein the second end 24*b* of the spring tightly clasps the stud 42 with positive fit, thereby imparting its torque. The first end 24*a* of the spring can be tightly screwed to the handle 10 of the second pincer part 4 or rigidly fastened in another suitable way, especially in a connection point 46 located in the region of the half-length of handle 10 turned toward the handle's open end. It is especially suitable for the connection point 46 to be located approximately in the transition region between the middle and final third of the length of the handle 10. In contrast, the spring fastening point 26 of the first pincer part 2 is installed in the region of the half of handle 8 this is turned toward the connecting region 6, especially in the region of the third of handle 8 turned toward the connecting region 6, and here preferably close to the transition to the middle third. The connection point 46 is consequently located closer to the handle's open end, whereas the fastening point 26 is closer toward the connecting region 6. This offset of the fastening points of the spring's ends 24*a*, 24*b* is important for the kinematics of the pincer parts 2, 4.

In another preferable embodiment, the fully opened opening width is limited by stopping means 48 (see FIG. 4*c*). Here the second pincer part 4 features a preferably cam-like stop element 50, which cooperates with a stop face 52 in the region of the jaw 12 of the first pincer part 2 to restrict the opening.

The pincer parts 2, 4 preferably consist primarily of punched sheet metal parts, each made of two congruent sheet metal parts 54 and 56 defining the basic shape of the pincer part. For this, we refer to the cross section in FIG. 3. Other sheet metal parts corresponding to the shape of the jaws are installed between these two metal parts 54, 56 in the region of the jaws 12, 14, so that a solid packet occurs here at the time. The metal parts are preferably screwed together by extending screws 57 perpendicularly through the parts. But a riveted joint could also be provided. The sheet metal embodiment makes it particularly inexpensive to manufacture.

As far as the first preferred embodiment according to FIGS. 1–5*c* is especially concerned, the two metal parts 54, 56 of the first pincer part 2 are separated from each other in the connecting region 6 in such a manner in this case, that a passageway 58 is formed for the second pincer part 4 which is crossing. The two metal parts 54, 56 of the second pincer part 4 are preferably located directly on top of each other in this region, resulting in a reduced thickness, so that the second pincer part 4 can extend through the passageway 58. In this embodiment, the blocking means 22 now preferably consist first of a gear-tooth system 60 on the second pincer part 4 (the pincer part that is fed through the passageway 58) where it is on the side edge that is pointing away from the jaws 12, 14, and secondly of a blocking element 62, which cooperates with the gear-tooth system 60 and is located on the first pincer part 2. Here the blocking element 62 is preferably rigidly installed (i.e. immovable relative to the first pincer part 2) between the metal parts 54, 56 of the first pincer part 2. In this case, it is preferred that the blocking element be fastened as a filler piece in the region between the gear-tooth system 60 and the clearance 44 that remains to accommodate the spiral spring segment 38. It makes sense for the blocking element 62 to have an edge 62*a*, that is on the side turned toward the clearance 44 and bent to fit the course of the spiral spring segment 38 (see FIG. 2 for example). The blocking element 62 preferably features a corresponding, complimentary matching gear-tooth system 64 on its opposite side turned toward the gear-tooth system 60 of the second pincer part 4. The cooperation of this matching gear-tooth system 64 with the gear-tooth system 60 is easy to reconstruct, especially on the basis of FIGS. 5*a*–5*c*.

In accordance with FIG. 2, a side edge of the second pincer part 4, that is pointing away from the tooth-gear system 60 and therefore pointing toward the jaws 12, 14, forms a guideway 66 for a guide element 68 of the first pincer part 2. As illustrated, the guide element 68 is preferably designed as a rolling element, but can alternatively also be provided as a sliding element. In the adjusting movements for the jaw opening-width, as can be seen in FIGS. 4*a*–4*c*, the guide element 68 moves over the guideway 66, and preferably moves very easily with rolling friction (or alternatively with sliding friction). The course of the guideway 66 is designed to fit the desired kinematics.

As far as the additional variations pursuant to FIGS. 6–11 are concerned, the same parts are assigned the same labels as in FIGS. 1–5. Only the basic differences will therefore be explained in the following.

In the case of the embodiments in accordance with FIGS. 6 through 10*b*, a "reverse" crossing of the pincer parts 2, 4 is first provided in the connecting region 6. This means that the metal parts 54, 56 of the second pincer part 4 are separated to form a passageway 58, wherein the first pincer part 2 then extends through this passageway 58. The two metal parts 54, 56 of the first pincer part 2 are consequently located closely together in the connecting region 6.

The embodiment of FIG. 6 differs from those of FIGS. 1–5 through a different design of the blocking means 22. Here the second pincer part 4 features, in each metal part, a congruent elongated hole 70 in the connecting region 6, within which (at least) one guide element 72 attached to the first pincer part 2 is guided in correspondence with the shifting movement to adjust the jaw opening-width.

In accordance with FIGS. 6–9*b*, the blocking means 22 here consist first of a gear-tooth system 74 on the edge of the elongated hole 70 of the second pincer part 4, namely the edge that is nearest the jaws 12, 14, and secondly of the guide element 72, which also acts as a blocking element and cooperates with the gear-tooth system 74 for this reason. The guide element 72 can have a corresponding, complementary matching gear-tooth system 76 for its function as blocking element. The opposite edge of the elongated hole 70, located away from the jaws 12, 14, preferably forms a guideway 78 for the guide element 72. The guide element 72 slides on the guideway 78 during the adjusting movement of the jaw opening-width.

In the embodiment of FIG. 6, the guide element 72 is designed as a pivot-mounted detent pawl, which is preferably also shaped with a cam-like catch 80 which is on the side opposite the matching gear-tooth system 76 and cooperates with a fluting 81 of the guideway 78 in such a way, that it supports the engagement of the pawl with the gear-tooth system 74 during clamping.

Figure 7A:
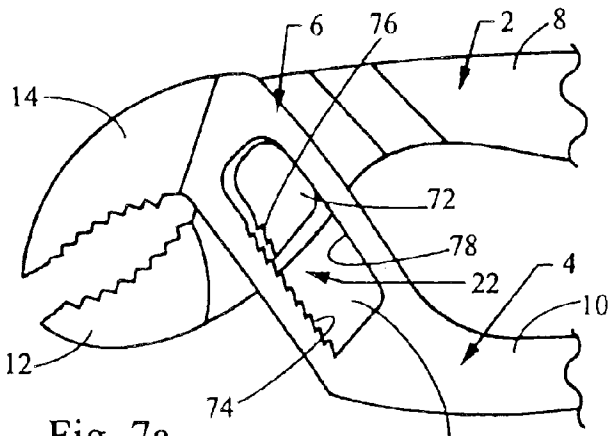
Figure 7B:
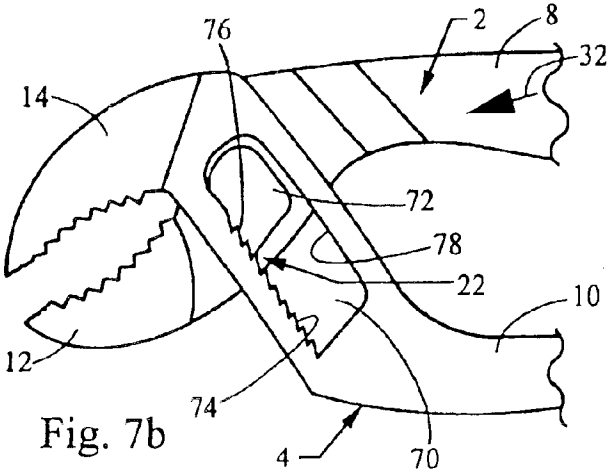

In the variation of FIGS. 7*a* and 7*b*, the guide element 72 is rigidly and immovably attached to the first pincer part 2. Engagement with the gear-tooth system 74 is exclusively caused by the swiveling motion of the pincer parts when the jaws 12, 14 stop against a workpiece.

Figure 8A:
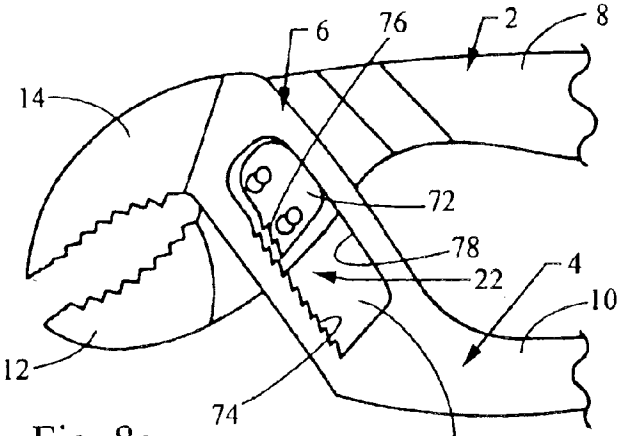
Figure 8B:
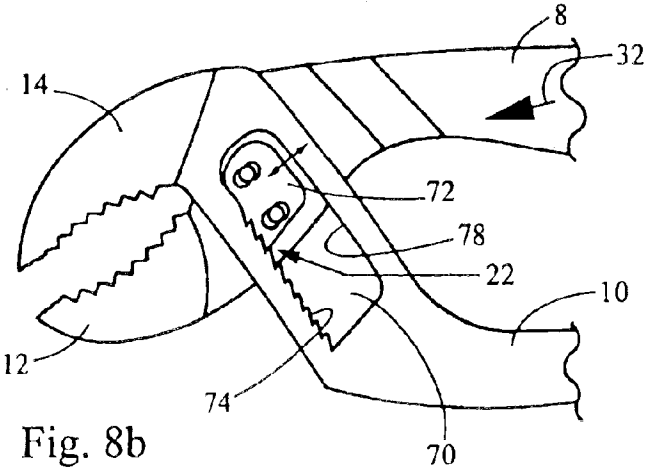
Figure 9A:
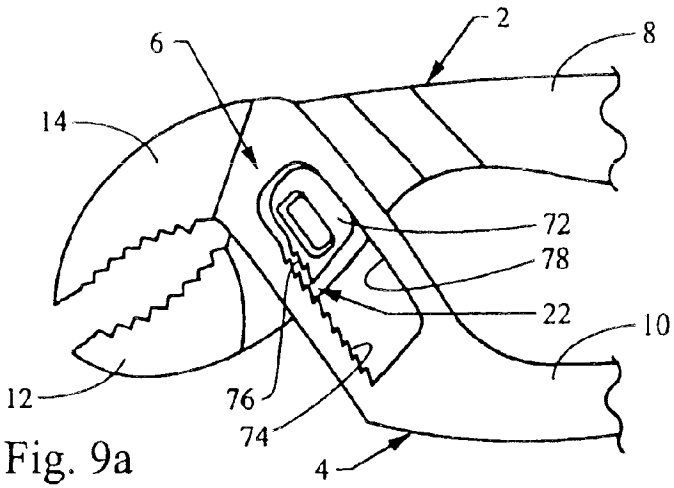
Figure 9B:
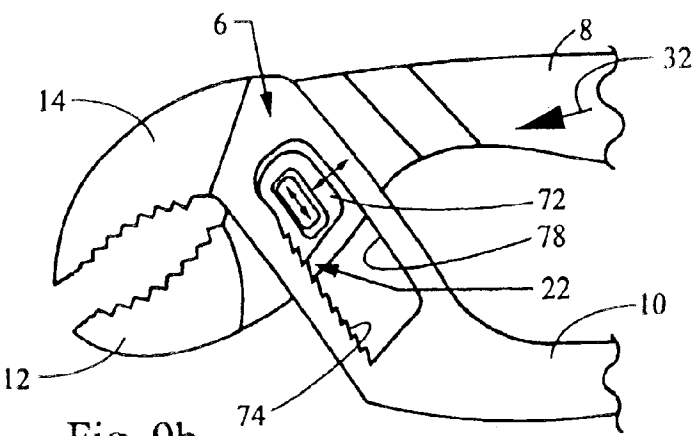

In the case of FIGS. 8*a* and 8*b*, the guide element 72 is float-mounted in such a way that it mainly moves relative to the first pincer part 2 in the transverse direction of the elongated hole 70. In the embodiment of FIGS. 9*a* and 9*b*, we are also dealing with a float-mounting of the guide element 72, here however in such a manner that it can move relative to the pincer part 2 in the transverse and longitudinal directions of the elongated hole 70. Through these measures, the guide element 72 can automatically align itself for its function as a blocking element so that an optimal engagement with the gear-tooth system 74 occurs.

As far as the embodiment of FIGS. 10*a* and 10*b* is concerned, here the blocking means 22 are designed similar to the embodiment of FIGS. 1–5. This means that the blocking means 22 are basically located outside the connecting region 6. A gear-tooth system 82 is provided on the side edge (the side pointing away from the jaws 12, 14) of the second pincer part 4 that forms the passageway. In its region that is outside the connecting region 6 and outside the passageway of the second pincer part 4, the first pincer part 2 features a rigidly attached blocking element 84, which cooperates in particular with the gear-tooth system 82 by means of a complementary matching gear-tooth system 86. Here the guide element 72 exclusively has a guide function within the elongated hole 70, in cooperation with the guideway 78 in particular. For this, the guide element 72 is preferably designed pin-shaped or bolt-shaped.

Finally, several preferable characteristics, which are applicable to all embodiments equally, will still be explained.

The embodiment illustrated in FIG. 11 basically corresponds to FIGS. 1 and 2. Only the type of rigid attachment of the first end 24*a* of the spring to the handle 10 is different. In this variation, the handle 10 features a recess 87, which is open toward the inside in the direction of the other handle 8 and which the end 24*a* of the spring engages. Moreover, the end 24*a* is curved like an eyelet and fastened with a stud or pin 88 that extends through the openings of the handle 10 and through the eyelet-shaped end 10 of the spring perpendicular to the plane of swiveling motion.

Here the abovementioned kink 40 can be superfluous. The spring segment 36 is preferably adjacent to the handle 10 near the edge of the recess 87, so that this contact point 89, as far as the position defined above relative to the length of the handle 10 is concerned, basically forms the actual connection point 46. The advantage of this embodiment is mainly in the simpler assembly in comparison to the embodiments of FIG. 2 or 6, for example. A resilient clamping sleeve, which only needs to be pressed in, can be used as stud or pin element 88.

In accordance with FIG. 1, a rubber-like cushioning element 90 for fixed stop absorption is installed between the handles 8, 10, which could possibly collide during gripping, on at least one of the two handles, as illustrated preferably on handle 10, on its inner side facing the other handle 8. This cushioning element 90 is preferably fastened to the handle 10 of the second pincer part 4 in such a way that it also simultaneously covers a fastener (especially a screw) of the first end 24*a* of the spring element 24.

As can be determined from FIG. 3 in particular, the pincer parts each also consist of two separated metal parts 54, 56 in the region of the handles 8, 10, wherein an addition filler 92 of plastic is preferably provided for each handle. Each filler 92 features a basically H-shaped cross section in such a manner that each metal part 54 or 56 respectively, lies flush in a corresponding recess of the filler 92. The fillers 92 can preferably be shaped ergonomically, contributing to good and comfortable manipulation of the pliers 1 in accordance with the invention.

In an unillustrated further development of the invention, adjustable stopping means can be provided within the connecting region 6, in such a way that the completely opened or maximum possible opening width (compare FIG. 4*c*) can be preset or restricted. This can be advantageous for clamping and holding smaller objects, because the pair of pliers 1 doesn't always need to be pressed together from its maximum possible opening width.

The invention is not limited to the examples that have been illustrated and described, but also includes all embodiments operating the same way in the spirit of the invention. Moreover, the invention is also not yet restricted to the combination of characteristics defined in claim 1 for the present, but can also be defined by any arbitrary other combination of particular characteristics as a whole from all of the disclosed individual characteristics. This means, that practically any individual characteristic of claim 1 can be deleted in principal and be replaced by at least one individual characteristic disclosed at another place in the application. In this respect, claim 1 is merely to be understood as a first attempt at formulation for an invention.

What is claimed is:

1. Water pump pliers comprising of two pincer parts crossing themselves in a connecting region, each of said pincer parts including a handle portion and a jaw, wherein said pincer parts are movably connected in said connecting region such that said first pincer part can be displaced relative to said second pincer part to adjust a law-opening-width and that said two pincer parts can reciprocally pivot, blocking means provided such that further shifting of said first pincer part is blocked when said jaws stop against a workpiece to be gripped, a one-piece spring element installed between said pincer parts and being rigidly connected at its ends with each of said handle portions of said two pincer parts in such a way, that, firstly, a releasing force (F), operating in an opening pivot direction of said jaws, acts upon said pincer parts, and, secondly, said spring element also acts upon said handle portion of said first pincer part with a torque directed around a spring fastening point (26) in such a way that said jaws automatically move to a fully opened opening width following a manual release of said pincer parts (handle portions).

2. Water pump pliers as recited in claim 1 wherein said spring fastening point is formed by a stud fastened in a clearance of said handle, an end of said spring tightly clasping said stud thereby imparting its torque.

3. Water pump pliers as recited in claim 1 wherein said spring fastening point of said first pincer part is located in a region in a half of said handle toward said connecting region.

4. Water pump pliers as recited in claim 1 wherein said fully opened opening width is limited by stopping means.

5. Water pump pliers as recited in claim 1 wherein second pincer part includes a cam stop element cooperating with a stop face in the region of said jaw of said first pincer part to restrict said fully opened opening width.

6. Water pump pliers as recited in claim 1 wherein said pincer parts primarily consist of sheet metal parts.

7. Water pump pliers as recited in claim 6, wherein in said connecting region, said first pincer part includes two sheet metal parts separated to form a passageway, whereby said second pincer part extends through said passageway.

8. Water pump pliers as recited in claim 7, wherein the blocking means has a gear-tooth system on said second pincer part located on a side surface that is pointing away from said jaws, and also having a blocking element, which cooperates with said gear-tooth system and is located on said first pincer part.

9. Water pump pliers as recited in claim 8, wherein said blocking element is rigidly installed between said sheet metal parts of said first pincer part between said gear-tooth system and a clearance that remain to accommodate said spiral spring element.

10. Water pump pliers as recited in claim 8 wherein said blocking element (62) features a corresponding, complimentary matching gear-tooth system on a side that is turned toward said gear-tooth system of said second pincer part.

11. Water pump pliers as recited in claim 7 wherein a side surface of said second pincer part, that is pointing toward said jaws, forms a guideway for a guide element of said first pincer part.

12. Water pump pliers as recited in claim 11, wherein said guide element is a rolling element or a sliding element.

13. Water pump pliers as recited in claim 1 wherein in said connecting region, said second pincer part consists of two sheet metal parts separated to form a passageway, whereby said first pincer part extends through said passageway.

14. Water pump pliers as recited in claim 13, wherein said second pincer part features an elongated hole in said connecting region, within which a guide element is attached to said first pincer part and is guided in correspondence with the shifting movement to adjust the jaw opening-width.

15. Water pump pliers as recited in claim 14, wherein the blocking means includes a gear-tooth system on a surface of said elongated hole of said second pincer part, namely the surface that is nearest the jaws, and said guide element, adapted to operate as a blocking element and cooperate with said gear-tooth system.

16. Water pump pliers as recited in claim 15, wherein said surface of said elongated hole located away from said jaws forms a guideway for said guide element.

17. Water pump pliers as recited in claim 16, wherein said guide element is a pivot-mounted detent pawl cooperating with a fluting of said guideway by means of a cam-like catch in such a way, that it supports engagement of said pawl with said gear-tooth system during clamping.

18. Water pump pliers as recited in claim 16, wherein said guide element is rigidly attached to said first pincer part.

19. Water pump pliers as recited in claim 16, wherein said guide element is float-mounted such that it can move relative to said first pincer part in transverse and longitudinal directions of said elongated hole.

20. Water pump pliers as recited in claim 14, wherein the blocking means includes a gear-tooth system located on a side of said second pincer part that forms said passageway, and also includes a rigidly attached blocking element, cooperating with said gear-tooth system and rigidly connected with said first pincer part in a region outside said passageway.

21. Water pump pliers as recited in claim 14 wherein said guide element has a guide function exclusively inside said elongated hole and is pin shaped.

22. Water pump pliers as recited in claim 1 further comprising a cushioning element for fixed stop absorption installed between said handles on an inner side facing said other handle, and which collide during gripping, on at least one of said two handles.

23. Water pump pliers as recited in claim 22, wherein said cushioning element is fastened to said handle of said second pincer part in such a way that it is also simultaneously covers a fastener fastening said first end of said spring element.

24. Water pump pliers as recited in claim 1 wherein each of said handle is formed of two separated metal parts and a filler of plastic, wherein said filler preferably features a basically H-shaped cross section in such a manner that each metal part lies flush in a corresponding recess of said filler.

25. Water pump pliers as recited in claim 1 further comprising adjustable stopping means provided within said connecting region such that an opening width can be present.

* * * * *